US009234369B2

(12) United States Patent
Gupta et al.

(10) Patent No.: US 9,234,369 B2
(45) Date of Patent: Jan. 12, 2016

(54) FURNACE DOOR LATCH ASSEMBLY

(71) Applicant: Carrier Corporation, Farmington, CT (US)

(72) Inventors: Nitu Gupta, Westfield, IN (US); Larry D. Rieke, Zionsville, IN (US); Edward Foxworthy, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 231 days.

(21) Appl. No.: 13/847,518

(22) Filed: Mar. 20, 2013

(65) Prior Publication Data

US 2013/0285392 A1 Oct. 31, 2013

Related U.S. Application Data

(60) Provisional application No. 61/613,615, filed on Mar. 21, 2012.

(51) Int. Cl.

| | |
|---|---|
| ***E05C 3/04*** | (2006.01) |
| ***E05B 3/04*** | (2006.01) |
| ***E05B 3/00*** | (2006.01) |
| ***E05B 15/00*** | (2006.01) |
| ***F27D 1/18*** | (2006.01) |
| *E05B 63/04* | (2006.01) |

(52) U.S. Cl.

CPC ... *E05B 3/04* (2013.01); *E05B 3/00* (2013.01); *E05B 15/0006* (2013.01); *E05C 3/042* (2013.01); *F27D 1/1858* (2013.01); *E05B 15/0053* (2013.01); *E05B 63/04* (2013.01); *Y10T 292/57* (2015.04)

(58) Field of Classification Search

USPC ..... 292/202, 204, 336.3, 347, 240, 241, 292/194, 213–215, 217, 218, 195, 197, 210, 292/200, 348, 350, DIG. 38

See application file for complete search history.

(56) References Cited

U.S. PATENT DOCUMENTS

| | | | | |
|---|---|---|---|---|
| 3,507,531 | A * | 4/1970 | Smith | 292/241 |
| 4,443,032 | A * | 4/1984 | Bonassi | 292/202 |
| 4,556,244 | A * | 12/1985 | Bisbing | 292/65 |
| 4,586,736 | A * | 5/1986 | Dougherty | 292/202 |
| 4,627,249 | A * | 12/1986 | Dumortier | 70/139 |
| 4,911,489 | A * | 3/1990 | Hansen et al. | 292/336.3 |
| 5,492,380 | A | 2/1996 | Smallegan et al. | |
| 5,584,098 | A | 12/1996 | Koyama et al. | |
| 5,590,555 | A | 1/1997 | Kester et al. | |
| 5,732,578 | A | 3/1998 | Kang | |
| 5,732,580 | A | 3/1998 | Garnault et al. | |
| 5,803,021 | A | 9/1998 | Rourke et al. | |

(Continued)

FOREIGN PATENT DOCUMENTS

| | | |
|---|---|---|
| EP | 0894175 A2 | 2/1999 |
| EP | 0943676 A2 | 9/1999 |

(Continued)

*Primary Examiner* — Alyson M Merlino

(74) *Attorney, Agent, or Firm* — Cantor Colburn LLP

(57) ABSTRACT

A latch assembly for securing a furnace door to a furnace casing includes a latch for placement on an inside of the furnace door; a knob for placement on a front surface of the furnace door; a latch plate for placement between the latch and the knob; and a threaded screw for threadably coupling the knob to the latch. The latch plate supports the weight of the furnace door in a closed position and reduces a pinch force used for rotating the knob.

10 Claims, 4 Drawing Sheets

(56) References Cited

U.S. PATENT DOCUMENTS

| | | | | |
|---|---|---|---|---|
| 5,845,365 | A | 12/1998 | Howie, Jr. | |
| 6,079,756 | A | 6/2000 | Phillips | |
| 6,120,119 | A | 9/2000 | Jelinski et al. | |
| 6,131,970 | A | 10/2000 | Hurst et al. | |
| 6,138,484 | A | 10/2000 | Sauerland et al. | |
| 6,357,268 | B1 * | 3/2002 | Takimoto | 70/208 |
| 6,402,208 | B1 | 6/2002 | Shimizu | |
| 6,419,482 | B1 | 7/2002 | Sakata et al. | |
| 6,443,505 | B1 * | 9/2002 | Linares et al. | 292/195 |
| 6,502,871 | B1 * | 1/2003 | Malmanger | 292/204 |
| 6,666,053 | B2 | 12/2003 | Sadler | |
| 6,666,056 | B1 | 12/2003 | Horton | |
| 6,675,616 | B1 | 1/2004 | Horton | |
| 6,709,029 | B2 | 3/2004 | Cole | |
| 6,729,823 | B2 | 5/2004 | Sakata et al. | |
| 6,736,473 | B2 | 5/2004 | Cleveland et al. | |
| 6,966,582 | B1 | 11/2005 | Malone et al. | |
| 6,993,944 | B2 | 2/2006 | Hicks | |
| 7,048,312 | B2 | 5/2006 | Brunner | |
| 7,152,442 | B2 | 12/2006 | Char et al. | |
| 7,171,727 | B2 | 2/2007 | Wylie et al. | |
| 7,210,924 | B2 | 5/2007 | Mochizuki et al. | |
| 7,320,236 | B2 | 1/2008 | Monneret et al. | |
| 7,350,470 | B1 | 4/2008 | Stuhlbarg et al. | |
| 7,354,081 | B2 | 4/2008 | Kondratuk | |
| 7,360,381 | B1 * | 4/2008 | Leite | 70/208 |
| 7,389,610 | B1 | 6/2008 | McMakin et al. | |
| 7,398,664 | B1 | 7/2008 | Weinerman et al. | |
| 7,752,877 | B2 | 7/2010 | Burns | |
| 7,802,828 | B2 | 9/2010 | Hopkins et al. | |
| 7,819,658 | B2 | 10/2010 | Sakata et al. | |
| 7,926,315 | B2 | 4/2011 | Poletti | |
| 8,052,182 | B1 | 11/2011 | Weinerman et al. | |
| 2003/0033839 | A1 | 2/2003 | Chen et al. | |
| 2003/0047949 | A1 | 3/2003 | Brunner | |
| 2003/0094885 | A1 | 5/2003 | Cleveland et al. | |
| 2004/0107545 | A1 | 6/2004 | Worrell | |
| 2005/0241112 | A1 | 11/2005 | Worrell | |
| 2005/0241349 | A1 | 11/2005 | Monneret et al. | |
| 2005/0246866 | A1 | 11/2005 | Dalsing et al. | |
| 2006/0123599 | A1 | 6/2006 | Romero | |
| 2007/0166657 | A1 | 7/2007 | Sakata et al. | |
| 2007/0262590 | A1 | 11/2007 | Courter et al. | |
| 2008/0083253 | A1 | 4/2008 | Don et al. | |
| 2008/0258477 | A1 | 10/2008 | Wagner et al. | |
| 2008/0276925 | A1 | 11/2008 | Griswold et al. | |
| 2009/0211318 | A1 | 8/2009 | Pilotelli | |
| 2010/0199727 | A1 | 8/2010 | Varney et al. | |
| 2010/0199737 | A1 | 8/2010 | Pellmann et al. | |
| 2010/0213724 | A1 | 8/2010 | Uyeda | |
| 2010/0307207 | A1 | 12/2010 | Vogel et al. | |

FOREIGN PATENT DOCUMENTS

| | | | |
|---|---|---|---|
| EP | 1182694 | A2 | 2/2002 |
| EP | 1195807 | A1 | 4/2002 |
| GB | 2379480 | A | 3/2003 |
| WO | 9740247 | A2 | 10/1997 |
| WO | 2005020765 | A2 | 3/2005 |

* cited by examiner

FURNACE DOOR LATCH ASSEMBLY

CROSS-REFERENCE TO RELATED APPLICATIONS

This application claims the benefit of U.S. provisional patent application Ser. No. 61/613,615 filed Mar. 21, 2012, the entire contents of which are incorporated herein by reference.

FIELD OF INVENTION

This invention relates generally to furnaces and, more particularly, to a furnace door latch assembly that is ergonomically designed.

DESCRIPTION OF RELATED ART

Furnaces often include doors to provide access to internal components. Door latches are used to secure the door to the furnace cabinet, and allow for the door to be opened. Typically, a door latch includes a two piece door knob and latch to secure the door. However, this latch requires a greater amount of turning or pinch force to rotate the knob and unlock the door. Improvements in a door latch assembly for a furnace door would be well received in the art.

BRIEF SUMMARY

According to an aspect of the invention, a latch assembly that secures a furnace door to a furnace casing includes a latch for placement on an inside of the furnace door; a knob operable for placement on a front surface of the furnace door; a latch plate for placement between the latch and the knob; and a threaded screw for threadably coupling the knob to the latch. The knob includes a knob body having a cylindrical portion and an arcuate portion that is directly opposed. Also, the latch plate supports the weight of the furnace door in a closed position and reduces a pinch force used for rotating the knob.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the FIGURES.

DETAILED DESCRIPTION

An embodiment of a latch assembly for a door of a furnace includes a latch plate coupled to a latch, a knob and a threaded screw. The latch plate is coupled to the door and is located inside the furnace. In an embodiment, the latch plate includes tabs that support the weight of the door when the latch assembly is in a latched position. Also, the latch includes a plurality of tabs that are coupled to corresponding grooves in the knob. A screw threadably couples the knob to the latch and creates a seal between the latch plate and the furnace door as it securely holds the assembled latch, latch plate and knob together.

Figure 1:
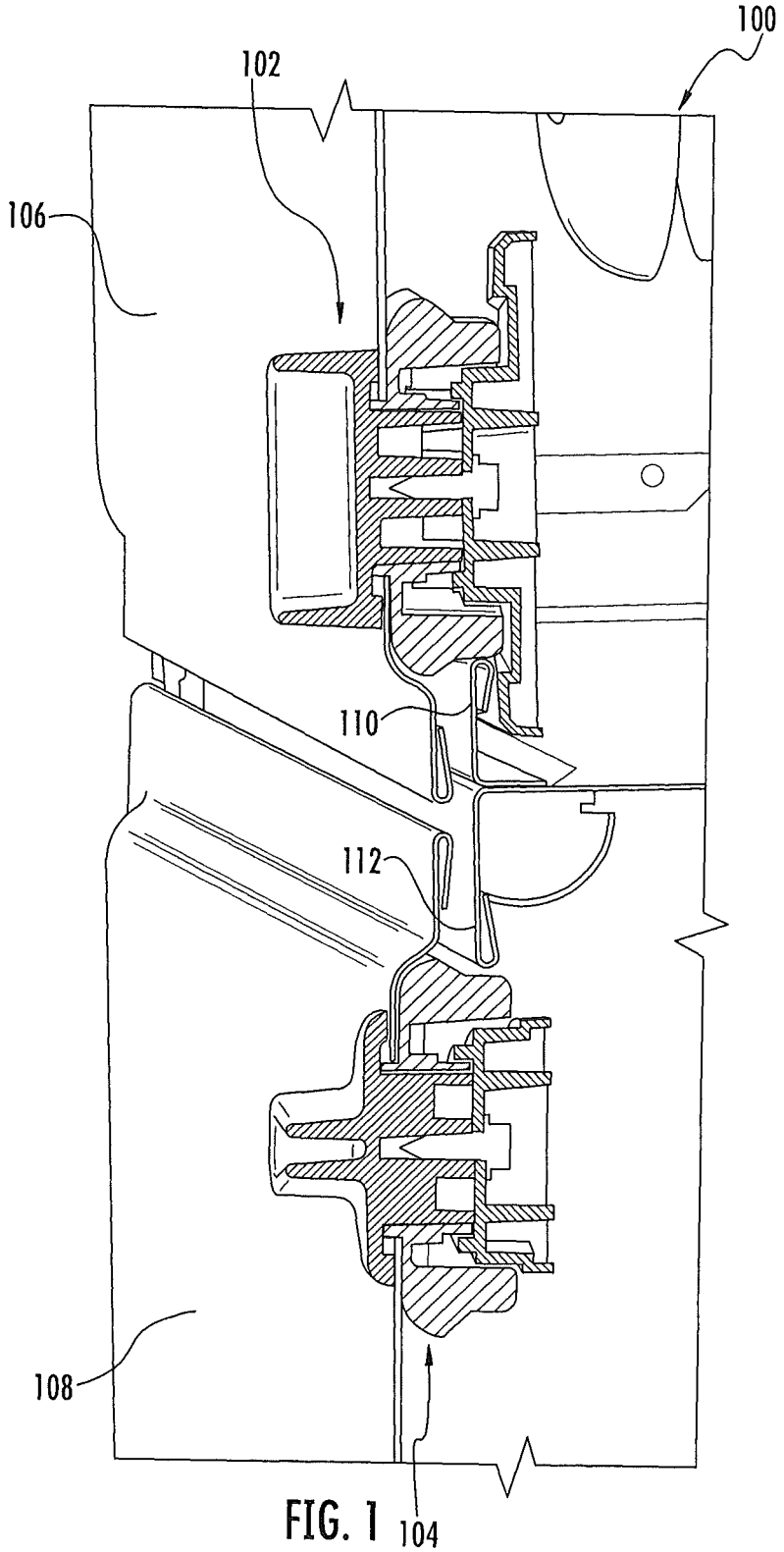
FIG. 1 depicts a perspective cross-sectional view of latch assemblies mounted on furnace doors according to an exemplary embodiment of the invention.

Referring now to the drawings, FIG. 1 depicts a partial perspective view of a furnace 100 including latch assemblies 102 and 104 according to an exemplary embodiment of the invention. Particularly, furnace 100 is shown with latch assemblies 102, 104 that may be selectively coupled to respective furnace doors 106, 108 for securing the furnace doors 106, 108. The furnace doors 106, 108 provide access to compartments in furnace 100. In one non-limiting embodiment, furnace 100 is shown with two latch assemblies 102, 104, but additional latch assemblies that are substantially similar may be used without departing from the scope of the invention. In an exemplary embodiment, two furnace doors 106, 108 may be used, one to access the upper compartment (or burner compartment) and one to access a lower compartment (or blower compartment). The upper compartment houses a heat exchanger (not shown) while the lower compartment houses a controller and a blower (not shown). Also, latch assemblies 102, 104 may be selectively rotated clockwise or counter-clockwise in order to secure doors 106, 108 to respective furnace casings 110, 112. Specifically, each latch assembly 102, 104 may be continuously rotated every 90 degrees (i.e., perform a complete rotation in either the clockwise or counter-clockwise direction) in order to latch or unlatch doors 106, 108. In another example, the latch assemblies 102, 104 may be rotated by 90 degrees in either direction in order to latch or unlatch the doors 106, 108. Each latch assembly 102, 104 includes a pair of equally spaced fingers (FIG. 5) that allows the latch assemblies 102, 104 to stay in its rotated position after every 90 degrees of rotation until the next rotation of latch assembly 102, 104. Also, latch assemblies 102, 104 include a latch plate (shown in FIG. 2) that allows the latch assemblies 102, 104 to be used in multiple orientations (e.g., top of door and bottom of door) so that only one latch design is needed and doors can be moved from a top location to a bottom location by reorienting the latch assemblies 102, 104. It is to be appreciated that the latch assemblies 102, 104 are substantially similar, and a description of latch assembly 102 described herein provides an adequate description of latch assembly 104.

Figure 2:
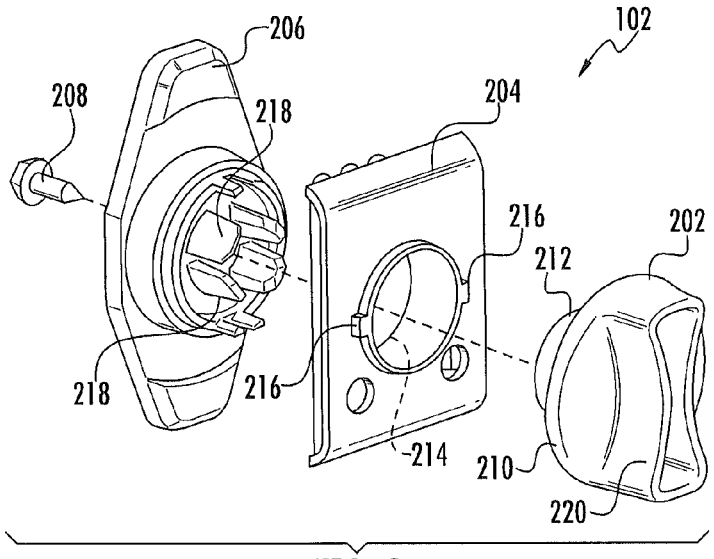
FIG. 2 depicts an exploded perspective view of a latch assembly according to an exemplary embodiment of the invention.
Figure 3A:
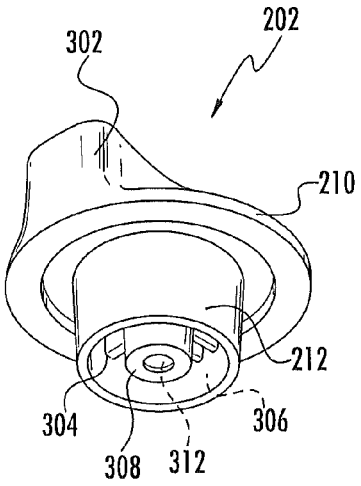
FIG. 3A depicts a perspective view of a knob according to an exemplary embodiment of the invention.
Figure 3B:
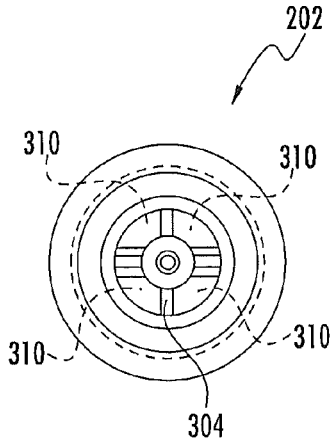
FIG. 3B depicts a bottom elevation view of the knob shown in FIG. 3A according to an exemplary embodiment of the invention.

FIG. 2 depicts an exploded perspective view of latch assembly 102 according to an exemplary embodiment of the invention. Particularly, latch assembly 102 includes a knob 202, latch plate 204, latch 206 and screw 208 that may be selectively coupled to each other. In one embodiment, the knob 202, latch plate 204, and latch 206 may be made from a polycarbonate material, but other similar types of materials may be used in other embodiments. The knob 202 has a generally circular or "disc-shaped" body portion 210 with a generally cylindrical portion 212 at a first end and an "hourglass" shaped arcuate portion 220 at a directly opposed second end. The cylindrical portion 212 may be slidably coupled to latch plate 204 in latch assembly 102. Also, the arcuate portion 220 serves as a finger grip for a user to rotate knob 202 in order to latch or unlatch the latch assembly 102, as is shown and described herein. Further, the latch plate 204 is generally rectangular in shape and includes a plurality of protrusions 216 that are diametrically opposed along a horizontal axis around the circumference of aperture 214. The plurality of protrusions 216 may engage corresponding grooves or slots in furnace door 106 (FIG. 1) to position the latch plate 204 on door 106 (FIG. 1) in a vertical direction. Also, the protrusions 216 cooperate with corresponding grooves or slots in furnace door 106 and prevent the latch plate 204 from rotating when knob 202 is rotated during latching or unlatching of latch assembly 102. Further, latch 206 has a plurality of substantially similar arcuate tabs 218 that frictionally snap or engage grooves 310 (FIG. 3A-3B). The arcuate tabs 218 facilitate rotation of the latch 206 when the knob 202 is rotated, as is shown and described herein. Further, a threaded screw 208 is provided to threadably couple the latch 206 to knob 202 and hold the latch assembly 102 together. The orientation of arcuate portion 220 provides a visual cue into whether the latch assembly 102 is in latched or unlatched. In a latched position, the arcuate portion 220 is rotated and oriented vertically (as is shown in FIG. 2), which causes the latch 206 to be vertically oriented (i.e., the longitudinal axis of latch 206 is oriented vertically). In an unlatched position, the arcuate portion 220 is oriented horizontally, which causes the latch 206 to be similarly horizontally oriented (i.e., the longitudinal axis of latch 206 is oriented horizontally).

FIGS. 3A-3B depict a view of knob 202 including the cylindrical portion 212 according to an exemplary embodiment of the invention. As shown in FIG. 3A, knob 202 has a generally cylindrical "disc-shaped" body portion 210 with a generally arcuate portion 302 at a first end and a generally cylindrical portion 212 at a diametrically opposed second end. The cylindrical portion 212 is located transversely to the body portion 210 and includes partitions 304, which are recessed within an interior cavity 306 of cylindrical portion 212. The interior cavity 306 is substantially coextensive with a longitudinal length of cylindrical portion 212. In an embodiment, as shown in FIG. 3B, partitions 304 separate the interior cavity 306 (FIG. 3A) into a plurality of spaced grooves 310 that are substantially similar. As particularly shown in FIG. 3B, four grooves 310 are provided in interior cavity 306 (FIG. 3A) for receiving the tabs 218 (FIG. 2). The tabs 218 (FIG. 2) frictionally engage the grooves 310 when knob 202 is coupled to latch 206 (FIG. 2). But, in another embodiment, additional grooves that are substantially similar to groove 310 may be provided to receive additional tabs that are substantially similar to tabs 218 in latch 206 (FIG. 2). Referring back to FIG. 3A, interior cavity 306 includes a threaded portion 308 that is substantially coextensive with the cavity 306. Also, threaded portion 308, which includes a cavity 312, which is threaded on an internal surface for receiving complementary threads of screw 208 (FIG. 2). In an embodiment, portion 308 may be initially provided with a smooth blind cavity 312 of a sufficient diameter for receiving screw 208. The screw 208 forms threads on an interior surface of the cavity 312 as the screw 208 is threadably inserted into the cavity 312 during initial assembly of the latch assembly 102 (FIG. 2). In another embodiment, the cavity 312 may be threaded during manufacture without having the screw 308 form the threads on the interior surface of the cavity 312.

Figure 4A:
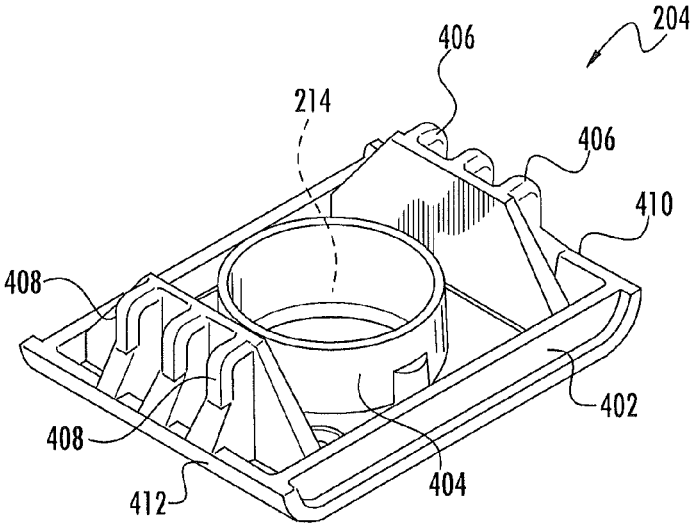
FIG. 4A depicts a perspective view of a latch plate according to an exemplary embodiment of the invention.
Figure 4B:
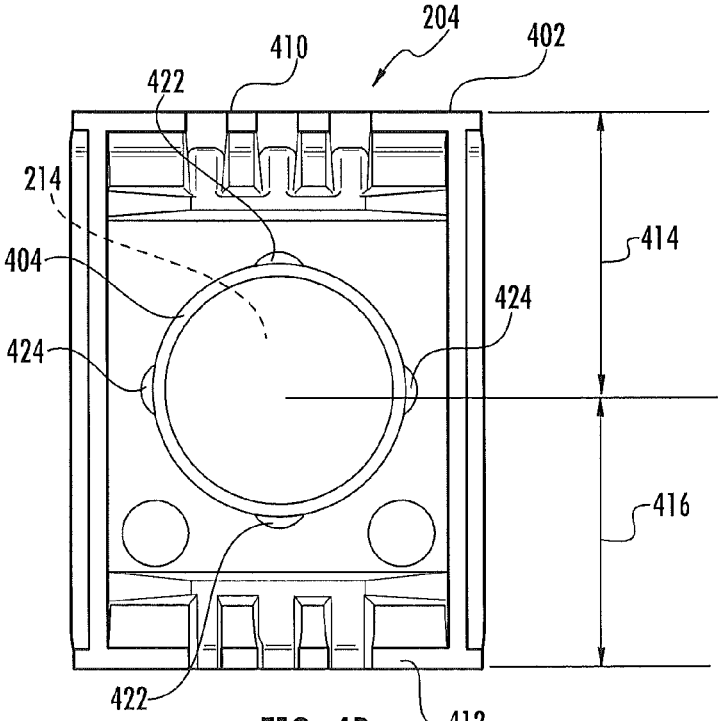
FIG. 4B depicts a bottom elevation view of the latch plate shown in FIG. 4A according to an exemplary embodiment of the invention.

FIGS. 4A-4B depict a view of latch plate 204 according to an embodiment of the invention. As shown in FIG. 4A, latch plate 204 has a generally rectangular shaped body 402 from first end 410 to second end 412. Body 402 has a generally cylindrical portion 404 that extends orthogonally from a longitudinal axis of body 402. Also, cylindrical portion 404 has a bore or opening 214 therethrough for receiving cylindrical portion 212 (FIGS. 2-3) of knob 202 (FIG. 2). The cylindrical portion 212 of knob 202 (FIG. 3A) rotates within the bore 214 when the assembled latch assembly 102 (FIG. 1) is rotated during latching or unlatching. This rotation within bore 214 prevents the cylindrical portion 212 from direct contact with an edge of either furnace door 106, 108 and possible wear when knob 202 (FIG. 3A) is rotated. A plurality of spaced ribs 406 and 408 are provided at first end 410 and second end 412, respectively. In one non-limiting example, the latch plate 204 may be installed in door 106 (FIG. 1) with end 410 positioned above end 412 with the door 106 (FIG. 1) in a closed position. In this configuration, the ribs 408 rest on an edge of casing 110 or 112 (FIG. 1) and support the weight of the furnace door 106 (FIG. 1). This reduces the turning or pinching force needed to rotate knob 202 clockwise or counter-clockwise during latching or unlatching latch assembly 102. In another embodiment, the latch plate 204 may be installed with end 412 positioned above end 410 without departing from the scope of the invention.

In an embodiment, as shown in FIG. 4B, latch plate 204 has a plurality of semi-spherical protrusions 422, 424 that are equally spaced around the circumference of cylindrical portion 404. In the example shown, the protrusions 422 are vertically oriented around the circumference of aperture 214 while protrusions 424 are horizontally oriented around the circumference of bore or aperture 214. The protrusions 422, 424 engage or abut tabs 510 (FIG. 5A) for every 90 degrees of rotation of latch 206 (FIG. 2) as is shown and described in reference to FIG. 5A. Also, aperture 214 is offset from first end 410 and second end 412 in order to accommodate varying tolerances during manufacturing (i.e., aperture 214 is offset from a center point of the body 402). Particularly, the center of aperture 214 is at a height 414 from end 410 and at a height 416 from end 412. Height 414 varies from height 416 and may be adjusted accordingly to accommodate varying manufacturing tolerances.

Figure 5A:
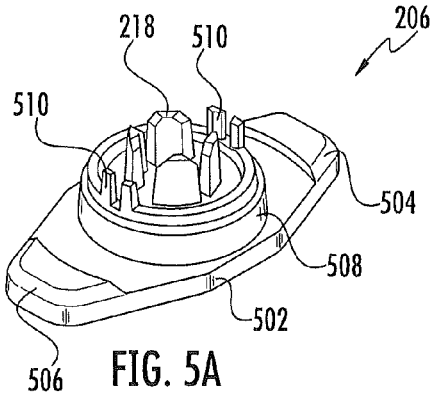
FIG. 5A depicts a perspective view of a latch according to an exemplary embodiment of the invention.
Figure 5B:
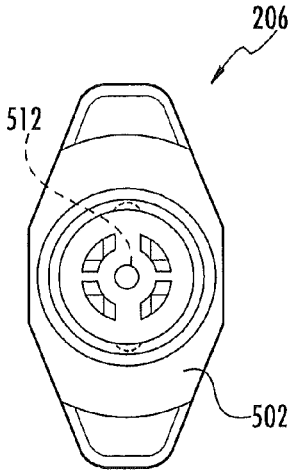
FIG. 5B depicts a front elevation view of the latch shown in FIG. 5A according to an exemplary embodiment of the invention.

FIGS. 5A-5B depict a view of latch 206 including a pair of spaced tabs 218 according to an exemplary embodiment of the invention. As shown in FIG. 5A, latch 206 has a generally oval shaped body 502 and includes a first latch portion 504 and a diametrically opposed second latch portion 506. In one non-limiting example with reference to door 106, when the latch 206 is in a first orientation (i.e., latch portions 504, 506 aligned horizontally), door 106 (FIG. 1) can be mounted against casing 110 (FIG. 1) as latch body 502 and latch portions 504, 506 clear the opening in casing 110 (FIG. 1) and allow door 106 to be opened in this orientation (i.e., latch assembly 102 is unlatched). In another example, when the latch 206 is in a second orientation (i.e., latch portions 504, 506 are aligned vertically), door 106 can be mounted against casing 110 (FIG. 1) and latch portions 504, 506 engage the inside surface of casing 100 (FIG. 1), and prevents the latch 206 from clearing an edge of the casing, thereby latching the door 106 to the casing 110 (FIG. 1).

Also, body 502 has a generally cylindrical portion 508 that is orthogonal to the longitudinal axis of the body 502. The cylindrical portion 508 has a pair of spaced tabs 510 that are diametrically opposed to each other around a circumference of portion 508. Additionally, cylindrical portion 508 includes a plurality of arcuate tabs 218, which are substantially similar, within an interior of the portion 508. The tabs 218 are received in grooves 310 (FIG. 3B) and cause a rotation in latch 206 as knob 202 (FIG. 2) is rotated. Also, as shown in FIG. 5B, latch 206 includes an aperture 512 that traverses body 502. The aperture 508 has a diameter that is slightly larger than a width of the body of screw 208 but smaller than the head of screw 208.

Figure 6:
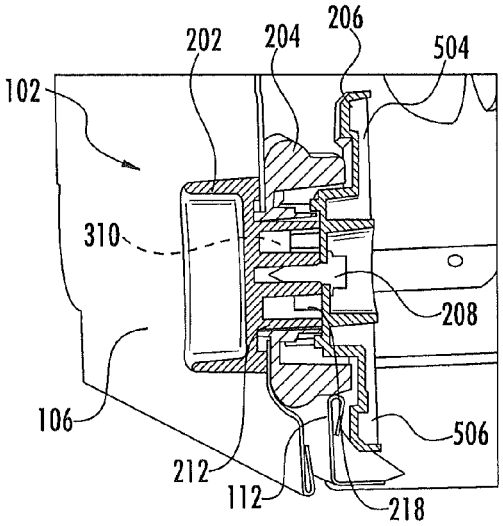
FIG. 6 depicts a perspective cross-sectional view of a latch assembly according to an exemplary embodiment of the invention.

In operation and with reference to FIG. 6, latch plate 204 may be coupled to an inside surface of door 106 by aligning aperture 214 (FIG. 2) with a complementary sized opening in door 106 so that protrusions 216 (FIG. 2) of latch plate 204 are received within complementary shaped grooves in door 106. Cylindrical portion 212 is mounted to door 106 and is coupled to latch plate 206 by passing cylindrical portion 212 from the outside of door 106 through the aperture 214 (FIG. 2). Also, knob 202 is coupled to latch 206 and receives the arcuate tabs 218 that engage grooves 310 within portion 212. The screw 208 holds the assembly together and creates an airtight seal between the latch plate 204 and the inside surface of furnace door 106. Also, ribs 408 (FIG. 4A) ride (or rest) on an edge of casing 112 to support the weight of furnace door 106 and position the door 106 (FIG. 1) in a vertical direction, thereby reducing the turning or pinching force needed to rotate knob 202 clockwise or counter-clockwise during latching or unlatching latch assembly 102. As shown, when the latch 206 is in a first orientation (i.e., latch portions 504, 506 are aligned vertically), door 106 can be mounted against casing 112 (and latch portions 504, 506 engage the inside surface of casing 112 to latch the door 106 to the casing 112 and prevent the door 106 from being opened in this orientation. In another non-limiting example, the knob 202 may be rotated 90 degrees clockwise or counter-clockwise until tabs 510 (FIG. 5A) engages protrusions 424 (FIG. 4B) causing the latch portions 504, 506 to correspondingly rotate 90 degrees. In this orientation, latch portions 504, 506 clear the opening in casing 112 allowing door 106 to be opened (i.e., latch assembly 102 is unlatched).

The technical effects and benefits of embodiments relate to a latch assembly for a door of a furnace. The latch assembly includes a latch plate coupled to a latch, a knob and a threaded screw. The latch plate is coupled to the door and is located inside the furnace. The latch plate includes tabs that support the weight of the door when the latch assembly is in a latched position. Also, the latch includes a plurality of tabs that are coupled to corresponding grooves in the knob. A screw threadably couples the knob to the latch and creates a seal between the latch plate and the furnace door as it securely holds the assembled latch, latch plate and knob together.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that the aspects of the invention may include only some of the described embodiments. Accordingly, the invention is not to be seen as limited by the foregoing description, but is only limited by the scope of the appended claims.

The invention claimed is:

1. A latch assembly for securing a furnace door to a furnace casing, comprising:

a latch for placement on an inside of the furnace door and rotatable between a latched position and an unlatched position, the latch comprises a latch body, the latch body having a first latch portion, a diametrically opposed second latch portion, and a latch cylindrical portion that is orthogonal to a longitudinal axis of the latch body;

a knob operable for placement on a front surface of the furnace door;

a latch plate for placement between the latch and the knob, wherein the latch plate comprises a latch plate body having a second cylindrical portion and a bore, the latch plate comprising a plurality of protrusions located circumferentially around the bore; and a threaded screw for threadably coupling the knob to the latch such that rotation of the knob causes rotation of the latch;

wherein the latch plate supports the weight of the furnace door in a closed position and reduces a pinch force used for rotating the knob;

wherein the latch cylindrical portion includes a plurality of tabs, each of the tabs operable to engage one of the plurality of protrusions on the latch plate to hold the latch in position in the latched position or the unlatched position, the latch is rotatable 360 degrees relative to the latch plate.

2. The latch assembly of claim 1, wherein the knob includes a knob body having a cylindrical portion and an arcuate portion that is directly opposed.

3. The latch assembly of claim 1, wherein the knob is coupled to the latch through a hole in the furnace door.

4. The latch assembly of claim 2, wherein the latch plate comprises at least one rib.

5. The latch assembly of claim 4, wherein the second cylindrical portion comprises the bore, wherein the bore receives the cylindrical portion of the knob.

6. The latch assembly of claim 4, wherein the at least one rib is operable to rest on an edge of the furnace casing and support the weight of the furnace door in the closed position.

7. The latch assembly of claim 5, wherein the bore is offset from a center point of the latch plate body.

8. The latch assembly of claim 1, wherein at least one of the first or the second latch portions is operable to engage the furnace casing in the latched position of the latch assembly.

9. The latch assembly of claim 1, wherein the latch includes an aperture that receives a screw body of the threaded screw.

10. The latch assembly of claim 9, wherein the knob includes a threaded portion that receives complementary threads of the screw body.

* * * * *